United States Patent [19]

Faccini et al.

[11] 4,396,368

[45] Aug. 2, 1983

[54] BI-PLANNER SWIRL COMBUSTOR

[75] Inventors: Ernest C. Faccini, Marbury; Norman J. Saunders, Nanjemoy, both of Md.

[73] Assignee: The United States of America as represented by the Secretary of the Navy, Washington, D.C.

[21] Appl. No.: 184,513

[22] Filed: Sep. 5, 1980

[51] Int. Cl.[3] ..... F23M 3/02; F23D 15/02

[52] U.S. Cl. ..... 431/9; 431/10; 431/158; 431/352; 60/757

[58] Field of Search ..... 431/9, 10, 158, 173, 431/352; 60/755, 756, 757, 758

[56] References Cited

U.S. PATENT DOCUMENTS 3,977,186 8/1976 Arvin et al. ..... 60/758

4,051,670 10/1977 Pierce ..... 60/755

4,301,657 11/1981 Penny ..... 60/758

4,351,251 9/1982 Brashears ..... 431/173

FOREIGN PATENT DOCUMENTS 700017 11/1953 United Kingdom ..... 60/758

*Primary Examiner*—Carroll B. Dority, Jr.

[57] ABSTRACT

A method and apparatus for combustion of fuel wherein in two mutually perpendicular air swirls are used. In the cylindrical section of the combustor, a horizontal swirl with respect to the combustor is set in motion. The conical section in conjunction with the cylindrical section forms a vertical swirl with respect to the combustor. Notably, the combustor is not dependent upon orientation in a gravity field.

9 Claims, 5 Drawing Figures

-a-

BI-PLANNER SWIRL COMBUSTOR

BACKGROUND OF THE INVENTION

The prior art combustion chambers in use have a series of center bodies and annular rings within the chamber for purposes of flame stabilization. In such prior art combustion chambers the chambers usually consist of a straight wall cylindrical apparatus. The cylindrical combustion chambers have been modified by introduction of swirling air into the chamber and removal of one center body and repositioning of the second center body so as to increase circulation of the air.

Therefore in the interest of increased efficiency including but not limited to reduction in use of fuel per unit of heat, in fuel consumption per hour, other efficiency considerations are possible and have been demonstrated by experimentation with swirling air.

Applicants also experimented with various methods and means of producing swirling air within the principle combustion chamber for the purpose of reducing side wall temperatures. When side wall temperatures of the combustor are reduced a variety of different materials can be used in the construction of the combustor which reduce the cost of the combustor. Therefore a number of different designs have been proposed by applicants for the increased efficiency and operation of a combustor that gives overall reduction in fuel consumption, reduces soot accumulation and is capable of reducing the cost of the combustor.

SUMMARY OF THE INVENTION

The invention comprises a combustion method and apparatus which is generally characterized by a lower circular cylindrical section with airflow controllers. The lower cylindrical section is contiguous with an upper section with airflow controllers. The cylindrical section sits upon and is in direct contact with a bottom plate, wherein the bottom plate is equipped with a swirler means and fuel nozzle.

The entire combustor is surrounded by an air jacket. The function of the air jacket is to direct an air supply to the combustor and is usually equipped with a supply fan on the bottom cover or side.

In one preferred embodiment of the invention the swirler introduces inner air at or near the base of the lower cylindrical section. This air is formed into a tornado or generally horizontal plane swirl. Inlet air directed into the upper conical section of the combustor is forced downward along the interior walls of the combustor and forms a doughnut swirl or swirling of inlet air in a generally vertical plane. Applicants summarize the invention as a combination effect of this swirling inlet air mixing with gases of combustion which greatly increases efficiency and results in an overall reduction in fuel consumption. In addition the combination of a horizontal swirl being mixed with and in direct contact with a vertical swirl has the effect of greatly reducing soot accumulation within the combustor.

A primary object of this invention is to reduce fuel consumption while increasing overall efficiency.

It is a further object of this invention to lower the outer wall temperature of the combustor chamber so that less expensive aloys may be used for the body of the combustor.

It is a further object of this invention to reduce soot accumulation.

It is another object of this invention to provide a relatively clean design that uses no center bodies or annular ring.

It is a still further object of the present invention to provide means to swirl air in a horizontal plane as well as to swirl air in a vertical plane and to obtain a combined effect when the two swirling air masses collide and intermix.

How the foregoing and other more specific objects of the invention are achieved will appear in the detailed description of an embodiment of the invention set forth herein and after in reference to the drawings.

DESCRIPTION OF THE PREFERRED EMBODIMENT

Although the invention is applicable to various fuel burning apparatus it will be discussed for purpose of illustration in connection with a combustion chamber used in a steam generator or a hot water boiler.

Figure 1:
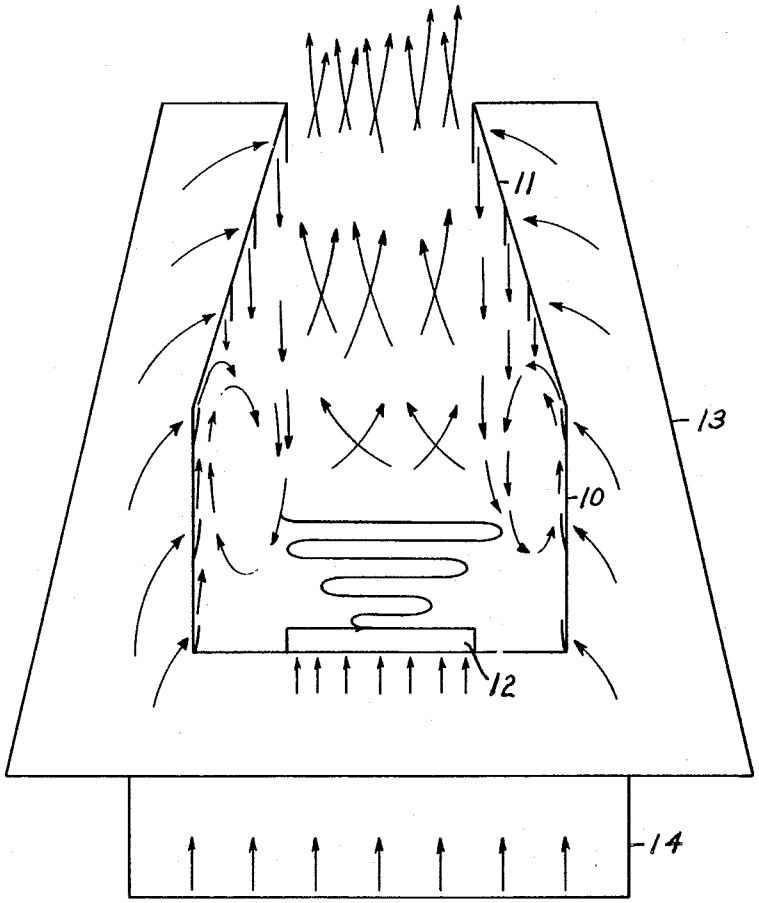
FIG. 1 is a verticle side elevation, part of the end section of a combustion chamber incorporating the features of the invention.

FIG. 1 illustrates a combustion chamber comprising a lower cylindrical section 10 in direct contact and contiguous with an upper truncated conical section 11. In that air is admitted to the base of cylindrical section 10 through a swirler mechanism 12, it is by means of the swirler mechanism, to be described in more detail hereinafter that a tornado or generally horizontal tornado swirl is produced. The tornado swirl generally is considered to be air that is swirling or turning in a horizontal plane.

The combustion chamber is surrounded by an air jacket 13 and air is admitted to the base of the air jacket 13 by a duct or inlet air constriction means 14.

In one preferred embodiment by means of holes or other openings in the truncated conical section 11, air is forced downward along the interior walls of the combustion chamber. When inlet air is forced downward along the interior walls of combustion chamber a doughnut swirl, best illustrated in FIG. 1 is set up and formed along the interior wall. This doughnut swirl intersects and intermixes with the tornado swirl also shown in FIG. 1 thereby yielding the synergistic results of this invention that gives greater efficiency, reduced fuel consumption and other advantages as described above.

Figure 2:
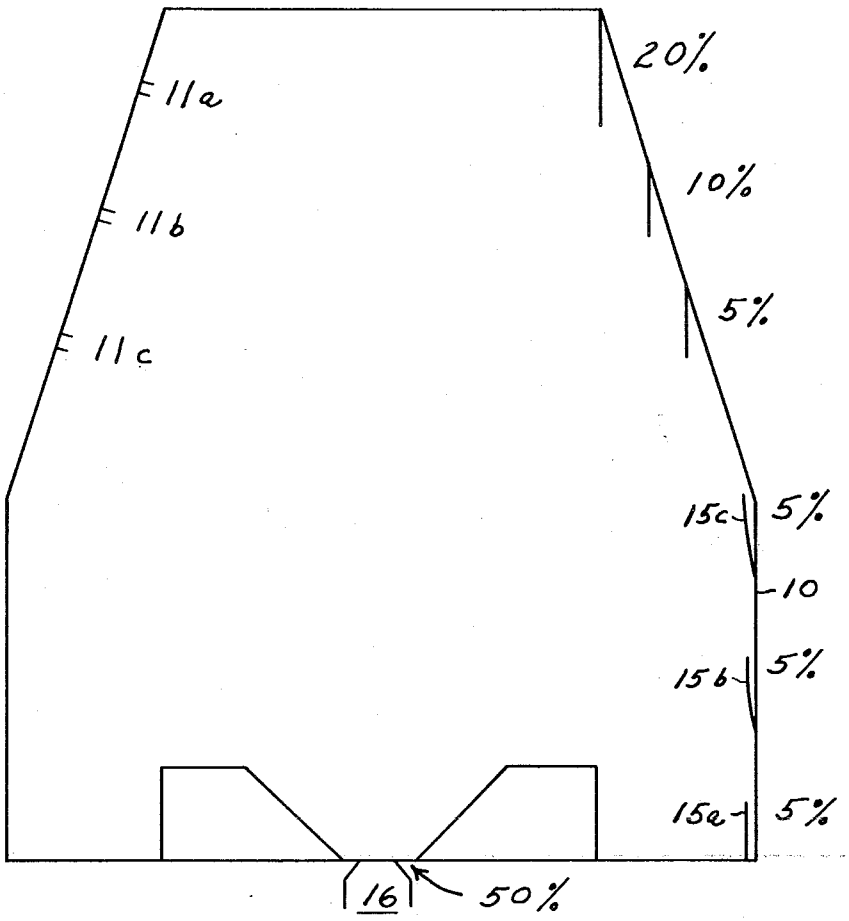
FIG. 2 is a cross sectional view of the combustor and the combustion chamber indicating the division of air flow that accomplishes the unique results of the invention.

FIG. 2 is a side elevation of a detailed drawing of the combustor illustrated in this invention. The swirler is located at or near the base of the cylindrical section 10 best illustrated in FIG. 1. In FIG. 2 the swirler is designed to distribute 50% of the inner air through the base plate and the remaining 50% of the air is distributed along the walls of the combustion chamber. In FIG. 2 the sidewalls of the cylindrical portion at the base of the combustion chamber 10 have three openings with inner flumes or baffles 15 that direct air in an upward direction in section 10. In the preferred embodiment shown in FIG. 2 15% of the air is directed through three openings 15*a*, 15*b* and 15*c* in the cylindrical base of the combustion chamber. In addition 50% of the inner air is directed around fuel nozzle 16 and is directed in an upper direction by the shape swirler mechanism 17. Conical section 11 is fitted with three openings 11*a*, 11*b* and 11*c* and as illustrated in this drawing a total of 35% inlet air is directed in a downward direction so as to create the doughnut shape swirl along the interior walls of the combustion chamber.

In one preferred embodiment of the invention a small baffle or other air directing means is utilized in connection with the openings 11*a*, 11*b* and 11*c* so as to direct the air in a downward direction.

Figure 3:
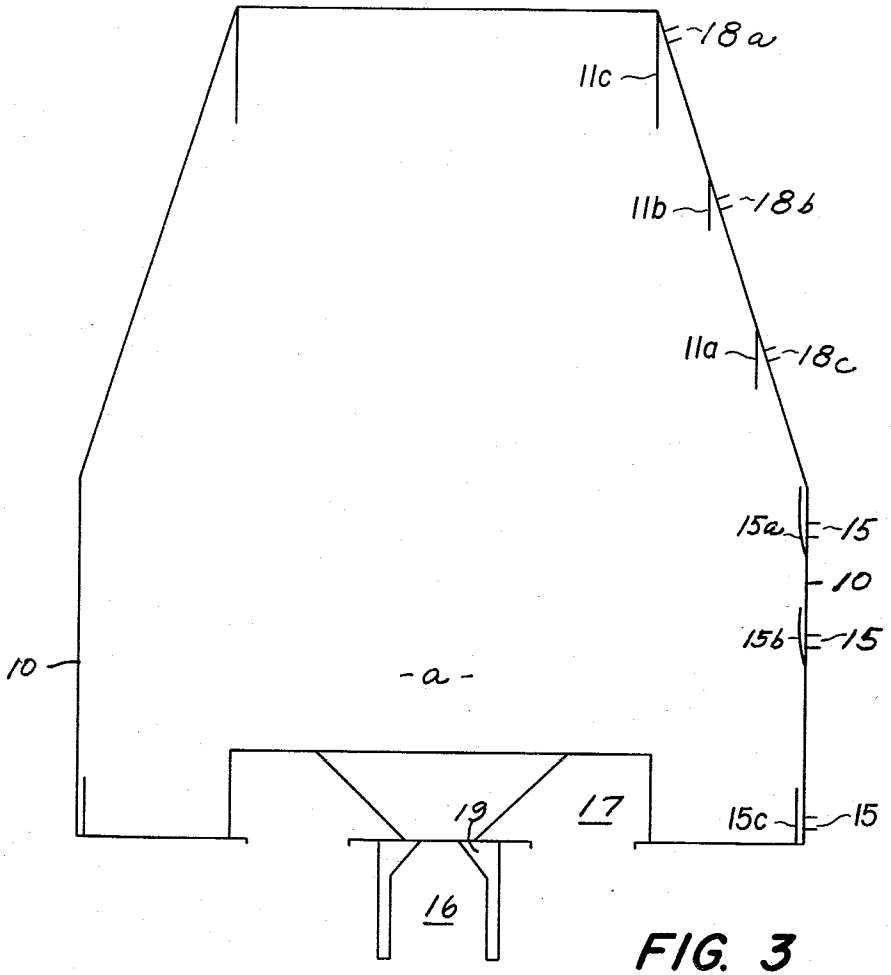
FIG. 3 is a side elevation view of the combustion chamber of the invention indicating hole size and air flow distribution and is considered a working engineering drawing.

In FIG. 3, a side elevation detailed drawing shows inlet air being admitted to the upper conical section 11 through openings 18*a*, 18*b* and 18*c*. Each of these openings is fitted on the interior wall with a baffle or other air directing means 11*a*, 11*b* and 11*c* so as to force the inlet air downward thereby helping and assisting to create a doughnut swirl. A suitable number of openings and air directing means for each opening may be provided on the interior wall of the conical section 11. By the same token a series of openings 15 are provided in the lower cylindrical wall within the baffles 15*a*, 15*b* and 15*c*. The inlet baffles 15*a*, 15*b* and 15*c* are used to direct inlet air in an upper direction again to help and assist in creating a doughnut swirl along the interior walls of the combustion chamber.

FIG. 3 also illustrates the fuel nozzle 16 around which an annular opening 19 allows inlet air to flow through and around the swirler mechanism 17 so as to create a tornado swirl having a low pressure in its center and thereby forces air to the exterior walls of cylindrical chamber 10 thereby creating a tornado swirl in the base combustion chamber.

It should be understood that any swirler or mechanism that allows a low pressure in the center portion of the chamber and a higher pressure by directing air through the interior wall of cylinder 10 can be utilized and substituted for the swirler mechanism 17 illustrated in FIG. 3.

Figure 4:
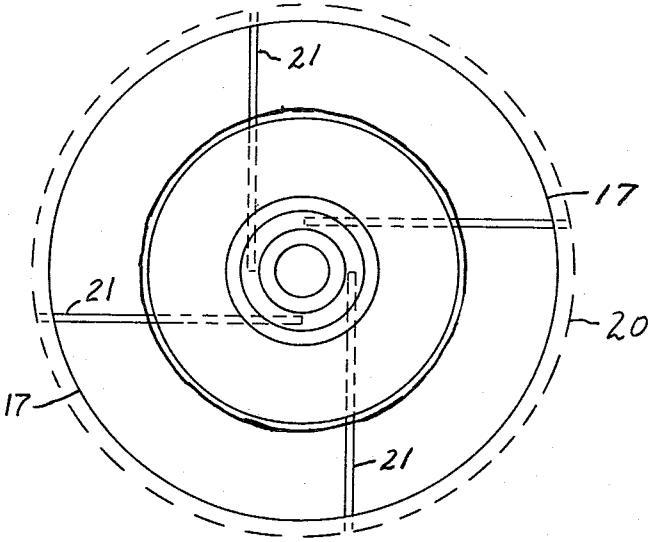
FIG. 4 is a bottom view of the swirler used at the base of the cylindrical section.
Figure 5:
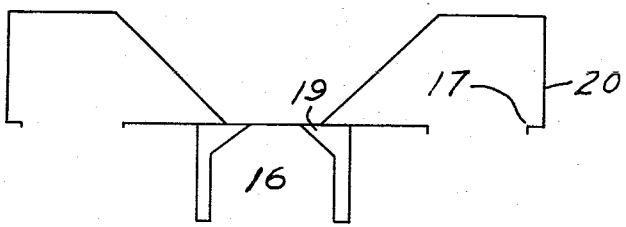
FIG. 5 is a side elevation of the swirler mechanism with a fuel nozzle with annular openings in the sidewalls.

FIG. 4 is a detailed drawing with a bottom view of the swirler illustrated in the other figures. This swirler 17 has a side wall 20 and annular opening 19 to allow inlet air in some specific portion to enter around the fuel nozzle 16. Annular area 19 is fed by a number of air vanes or other air conduit means 21. It is by the interaction of the pressurized inlet air through means such as guide vanes 21 that the inlet air is given a swirling motion. The swirling motion in FIG. 1 is in a counterclockwise direction and will simulate and form a counterclockwise tornado effect in the base of the cylindrical wall combustion chamber 10.

Many obvious modifications and embodiments of the specific invention other than those set forth above, will readily come to mind to one skilled in the art having the benefit of the teachings presented in the foregoing description and the accompanying drawings of the subject invention and hence it is to be understood that such modifications are included within the scope of the appended claims.

What is claimed as new and desired to be secured by Letters Patent of the United States is:

1. A combustion chamber comprising a lower cylindrical section having an end wall including means to provide a tornado swirl of air axially of the cylindrical section, and a contiguous upper frusto conical section wherein the frusto conical section is fitted with air inlet means spaced about the periphery of the frusto conical section to direct air along the inner wall of the frusto conical section and toward the lower cylindrical section, and the said cylindrical section has air inlet means spaced about its periphery for directing air along the inner wall of the cylindrical section and toward the conical section, and where the larger end of the frusto-conical section is connected to the cylindrical section and where the conical section is open at the smaller end and where a fuel nozzle means is located in the cylindrical section and centrally of the means to provide a tornado swirl of air.

2. The combustion chamber of claim 1 wherein one air directing means is provided for each inlet air means in the cylindrical section of the combustion chamber.

3. The combustion chamber of claim 1 wherein the movement of downward flowing air mix with upward flowing inlet air introduced around the periphery of the cylindrical section of the combustion chamber to form a doughnut shaped swirling air mass.

4. The combustion chamber of claim 3 wherein the doughnut swirl created by the upward and downward flowing air masses is moving essentially in a vertical plane.

5. The combustion chamber of claim 1 wherein an air jacket completely envelopes the entire combustion chamber.

6. The method of operating a combustion chamber chamber with a fuel burner means and where the combustion chamber has a lower cylindrical base section and an upper frusto conical section comprising the steps of: (a) introducing inlet air at the base of the chamber so as to form a tornado swirling effect and (b) introducing inlet air around the circumference of the base of the chamber in an upward direction along the inner wall of the chamber and (c) introducing and forcing inlet air downward along the inner wall of the frusto-conical section so as to form a doughnut swirling effect, and (d) introducing fuel from the fuel burner means axially of the combustion chamber at the base of the combustion chamber.

7. A combustion chamber as set forth in claim 1 wherein said means for providing a tornado swirl of air includes swirler vanes.

8. A combustion chamber as set forth in claim 7 wherein said swirler vanes surround said fuel nozzle.

9. A combustion chamber as set forth in claim 1 wherein said means for directing air in said frusto-conical and cylindrical sections include baffle means.

* * * * *